US007080654B2

(12) United States Patent
Yada et al.

(10) Patent No.: US 7,080,654 B2
(45) Date of Patent: Jul. 25, 2006

(54) METHOD FOR TRANSPORTING EASILY POLYMERIZABLE LIQUID BY PIPELINE

(75) Inventors: Shuhei Yada, Mie (JP); Kenji Takasaki, Mie (JP); Yasushi Ogawa, Mie (JP); Yoshiro Suzuki, Mie (JP); Hirochika Hosaka, Mie (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 10/856,804

(22) Filed: Jun. 1, 2004

(65) Prior Publication Data

US 2004/0216786 A1 Nov. 4, 2004

Related U.S. Application Data

(63) Continuation of application No. PCT/JP02/12670, filed on Dec. 3, 2002.

(30) Foreign Application Priority Data

Dec. 3, 2001 (JP) ..... 2001-368496
Jan. 23, 2002 (JP) ..... 2002-013814

(51) Int. Cl.
*F17D 1/08* (2006.01)

(52) U.S. Cl. ..... 137/1; 137/599.01; 137/599.18

(58) Field of Classification Search ..... 137/599.01, 137/599.18, 883, 236.1, 318, 320
See application file for complete search history.

(56) References Cited

U.S. PATENT DOCUMENTS

| | | | | |
|---|---|---|---|---|
| 1,956,009 | A * | 4/1934 | Diescher | 137/599.01 |
| 3,256,735 | A * | 6/1966 | Smith | 137/599.13 |
| 3,386,473 | A * | 6/1968 | Driscoll | 137/599.13 |
| 3,464,447 | A * | 9/1969 | Jones | 137/883 |
| 3,481,358 | A * | 12/1969 | Gardner | 137/512.5 |
| 3,481,365 | A * | 12/1969 | Keen | 137/883 |
| 3,516,638 | A * | 6/1970 | Piggott | 137/883 |
| 4,197,868 | A * | 4/1980 | Carson | 137/110 |
| 4,563,112 | A * | 1/1986 | Mokuya et al. | 137/599.01 |
| 6,581,637 | B1 * | 6/2003 | Hamamoto et al. | 137/563 |

FOREIGN PATENT DOCUMENTS

| | | |
|---|---|---|
| JP | 5-71700 | 3/1993 |
| JP | 6-11100 | 1/1994 |
| JP | 7-25908 | 1/1995 |
| JP | 7-215914 | 8/1995 |
| JP | 10-287612 | 10/1998 |
| JP | 2001-114705 | 4/2001 |

* cited by examiner

*Primary Examiner*—Stephen M. Hepperle
(74) *Attorney, Agent, or Firm*—Oblon, Spivak, McClelland, Maier & Neustadt, P.C.

(57) ABSTRACT

A method for transporting an easily polymerizable liquid by a pipeline having branches, wherein among pipelines branched at a branch point, one pipeline which may not be used over a long period of time, is provided with a valve to close the pipeline, within 500 mm from the branch point.

4 Claims, 6 Drawing Sheets

METHOD FOR TRANSPORTING EASILY POLYMERIZABLE LIQUID BY PIPELINE

CROSS REFERENCE TO RELATED APPLICATION

This is a Continuation Application of PCT Application No. PCT/JP02/12670, filed on Dec. 3, 2002, which was not published under PCT Article 21(2) in English. This application is based upon and claims the benefit of priority from the prior Japanese Patent Application Nos. 2001-368496, filed Dec. 3, 2001 and 2002-013814, filed Jan. 23, 2002, the entire contents of which are incorporated herein by reference.

BACKGROUND OF THE INVENTION

Field of the Invention

The present invention relates to a method for transporting an easily polymerizable liquid by a pipeline. Particularly, the present invention relates to a method for preventing an easily polymerizable liquid from polymerization in a pipeline such as a bypass pipe, when the easily polymerizable liquid is transported by the pipeline in e.g. a plant wherein the easily polymerizable liquid is handled. More particularly, it relates to a method for installing a bypass pipe on a main piping, so as to prevent clogging of the bypass pipe by the polymerizable compound to be transported.

At the time of handling an easily polymerizable liquid such as (meth)acrylic acid or its ester, a careful attention is being paid to prevent its polymerization. Usually, to such easily polymerizable liquids, various polymerization inhibitors are added to prevent their polymerization. Further, oxygen has a polymerization inhibiting effect, and accordingly, it is considered advisable to carry out its handling or storage in an atmosphere containing oxygen as far as possible. Further, if the temperature is high, the polymerization will be accelerated, and accordingly, it is considered advisable to handle such easily polymerizable liquids at a low temperature, and for example, distillation under reduced pressure is employed for their purification by distillation.

In a plant or the like wherein such an easily polymerizable liquid is handled, various means are employed to prevent its polymerization, as mentioned above. Nevertheless, certain polymerization may sometimes takes place. For example, in a plant for producing acrylic acid, propylene is catalytically oxidized in a vapor phase to form acrylic acid, this acrylic acid is absorbed in water to obtain an aqueous acrylic acid solution, which is distilled by a distillation apparatus comprising a plurality of distillation columns to obtain purified acrylic acid to be shipped. In the plant, pipelines connecting distillation columns, or distillation columns and storage tanks, are complicatedly laid, and polymerization may take place in such pipelines. Polymerization in a pipeline is likely to take place at a place where acrylic acid is likely to stay, for example, in a pipeline branched from the main pipe, such as a bypass pipe which is usually closed, or a pipe for withdrawing a test sample.

Heretofore, in a pipeline installation for transporting an easily polymerizable compound, a flow meter, a control valve, etc. are built in midway in the main pipeline.

At the portion of such a flow meter or a control valve, polymerization of the polymerizable compound took place, or the polymerization inhibitor or the like contained in the polymerizable compound precipitated, to clog these instruments. Accordingly, it was unavoidable to disassemble and clean them.

In order to make continuous operation possible without stopping the plant for producing the easily polymerizable compound even during the operation for disassembling and cleaning such instruments, it is common to install a bypass pipe on the main piping, to overpass the instruments such as the flow meter, the control valve, etc.

Heretofore, Such a bypass pipe was installed as branched at the same horizontal position or at a position lower than the main piping.

Thus, the conventional arrangement had a drawback that during the passage of the easily polymerizable compound through the main piping, a solidified product, etc. of the easily polymerizable compound tends to gradually stay and deposit at the same horizontal position or the lower position of the bypass pipe, to clog the inside of the bypass pipe, whereby the original purpose of installing a bypass pipe on the main piping can not be accomplished.

SUMMARY OF THE INVENTION

It is an object of the present invention to provide a method for preventing polymerization in a pipeline for transporting an easily polymerizable liquid.

It is another object of the present invention to provide a method for installing a bypass pipe in a piping installation for transporting an easily polymerizable compound, so as to prevent clogging due to e.g. formation of a polymer in the bypass pipe.

The present inventors have conducted an extensive research to accomplish the above objects and have arrived at the present invention which has the following gists.

(1) A method for transporting an easily polymerizable liquid by a pipeline having branches, wherein among pipelines branched at a branch point, one pipeline which may not be used over a long period of time, is provided with a valve to close the pipeline, within 500 mm from the branch point.

(2) A method for transporting an easily polymerizable liquid by a pipeline, wherein the pipeline is provided with a bypass pipeline having a length of within 1000 mm to bypass a part of the pipeline, and the bypass pipeline is provided with a valve to close the bypass pipeline, within 500 mm from the attached point at each end of the bypass pipeline.

(3) The method according to the above (2), wherein at least a part of the bypass pipeline is installed at a position higher than the main pipeline.

(4) The method according to the above (2) or (3), wherein at least a part of the branched portion or the connected portion of the bypass pipeline is rising upwards from the main pipeline at an inclination angle of from 3 to 90°.

(5) The method according to any one of the above (2) to (4), wherein one end of the bypass pipeline is branched from a position at the same height as the main pipeline, and the shut off valve is built in at a portion of the bypass pipeline located at said same height.

(6) A method for transporting an easily polymerizable liquid by a pipeline, wherein at a portion of the pipeline, the pipeline is branched to have a plurality of branched pipelines installed in parallel and provided midway with a device for the liquid to pass therethrough, and each branched pipeline is provided with a valve to close the branched pipeline, within 500 mm from the attached point at each end of the branched pipeline.

(7) The method according to any one of the above (1) to (6), wherein the valve to close the pipeline is installed within 300 mm from the branch point.

(8) The method according to any one of the above (1) to (7), wherein the easily polymerizable compound is (meth) acrylic acid and/or its ester.

Figure 1:
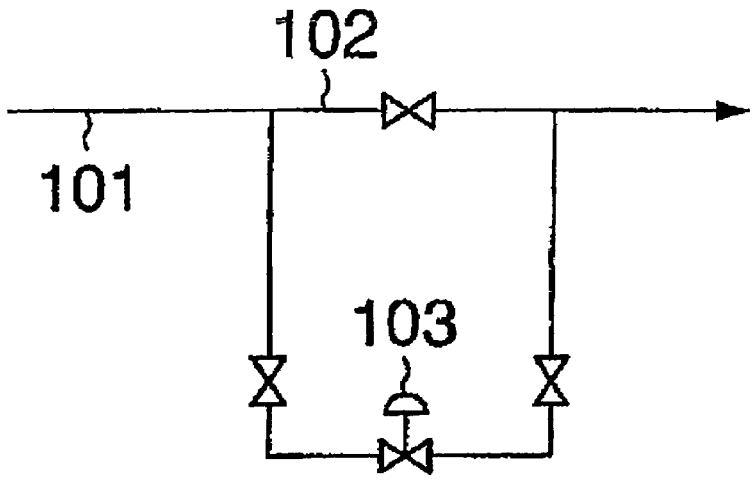
FIG. 1 is a view showing a bypass pipe to bypass a control valve, installed on a piping for transporting a liquid.

In the drawings, the reference symbols are as follows:

101, 301, 401 : Main pipeline
102: Bypass pipeline
103: Control valve
201: Pipeline
202: Strainer
203: Pump
302, 402: Withdrawing pipe
A: Acrylic acid-collecting column
B: Distillation column
C: High boiling separation column
D: High boiling decomposition reactor
FM: Flow meter
CV: Control valve
13: Main piping
14, 14-1, 14-2: Bypass pipe
15: Drain pipe
α: Rising inclination angle of bypass pipe

DETAILED DESCRIPTION OF THE PREFERRED EMBODIMENTS

The present invention may be applied to a pipeline transportation of an optional easily polymerizable liquid. However, it is particularly effective when it is applied to a pipeline transportation of (meth)acrylic acid or its ester. As an ester of acrylic acid, methyl acrylate, ethyl acrylate, butyl acrylate, isobutyl acrylate, t-butyl acrylate, 2-ethylhexyl acrylate, 2-hydroxyethyl acrylate, 2-hydroxypropyl acrylate, or 2-methoxyethyl acrylate, may, for example, be mentioned. As an ester of methacrylic acid, methyl methacrylate, butyl methacrylate, isobutyl methacrylate, t-butyl methacrylate or 2-hydroxyethyl methacrylate, may, for example, be mentioned.

These (meth)acrylic acids or their esters are usually handled in the presence of oxygen, whereby oxygen is dissolved therein, and various polymerization inhibitors are incorporated. The polymerization inhibitors may, for example, be t-butyl nitroxide; an n-oxyl compound such as 2,2,6,6-tetramethyl-4-hydroxypiperidine-1-oxyl, 2,2,6,6-tetramethylpiperidyl-1-oxyl, 2,2,6,6-tetramethylpiperidinooxyl, 2,2,6,6-tetramethyl-4-hydroxypiperidinooxyl or 4,4',4"-tris(2,2,6,6-tetramethylpiperidinooxyl) phosphite; a phenol compound such as hydroquinone, methoquinone, pyrogallol, catechol or resorcinol; a phenothiazine compound such as phenothiazine, bis(α-methylbenzyl) phenothiazine, 3,7-dioctylphenothiazine or bis(α-dimethylbenzyl)phenothiazine; and a copper compound such as cupric chloride, copper acetate, copper carbonate, copper acrylate, copper dimethyldithiocarbamate or copper dibutyldithiocarbamate.

In the present invention, at the time of transporting an easily polymerizable liquid by a pipeline, a pipeline which is branched from a main pipeline and which may not be used for a long time, for example over at least one month, is provided with a valve to close the piping, within 500 mm, preferably within 300 mm, from the branch point. As is well known, in a plant or the like, a pipeline for transporting a liquid is branched, so that pipelines which may not be used over a long time, are branched from a main pipeline. The diameters of such branched pipelines are determined depending upon the amounts for transportation, but they are usually at least 22.5 mm. Among such pipelines, there may be those which are not used for a few months, in some cases for more than six months or one year.

For example, as shown in FIG. 1, a bypass pipeline 102 may be installed to bypass a control valve 103 installed on the main pipeline 101, so that even when the main pipeline is required to be shut off for the maintenance or inspection of the control valve, transportation of a liquid can be continued via the bypass pipeline. The bypass pipeline is usually closed by a valve. Accordingly, a liquid will remain in the bypass pipeline from the branch point to the bypass pipeline to the valve, and in the case of a polymerizable liquid, polymerization is likely to take place at such a portion.

However, as in the present invention, if a valve to close the bypass pipe is installed within 500 mm, preferably within 300 mm, from the branch point, it is possible to substantially reduce the possibility that polymerization takes place at such a portion. The reason is not clearly understood, but is considered to be such that oxygen or a polymerization inhibitor in the liquid flowing through the main pipeline will be supplied by diffusion also to the liquid at such a portion. Namely, the concentration of oxygen or a polymerization inhibitor initially contained in the retained polymerizable liquid may decrease as the time passes, but oxygen or a polymerization inhibitor may be supplied by diffusion from the polymerizable liquid flowing through the main pipeline, and consequently, the concentration of such oxygen or polymerization inhibitor will be maintained to prevent polymerization.

Further, the bypass pipeline has a length of preferably within 1,000 mm, particularly preferably within 500 mm, and it is preferred to install a valve at a position of a length of preferably within 500 mm, particularly preferably within 300 mm, from each end, whereby it will be possible to prevent polymerization also at the downstream side of the valve without providing any special measure. Further, in such a case, it is preferred that at least a part of the bypass pipeline is installed at a position higher than the main pipeline, and at least a part of the branched portion or the connected portion of the bypass pipeline is rising upwardly from the main pipeline at an inclination angle of preferably from 3 to 90°, more preferably from 10 to 90°, particularly preferably from 45 to 90°. Further, it is preferred that one end of the bypass pipeline is branched from a position at the same height as the main pipeline, and a shut off valve is built in at a portion of the bypass pipeline located at said same height. The valve to be used in the present invention may be any valve so long as it is capable of opening and closing the pipeline, and a usual gate valve, ball valve, needle valve or butterfly valve may optionally be employed.

Figure 2:
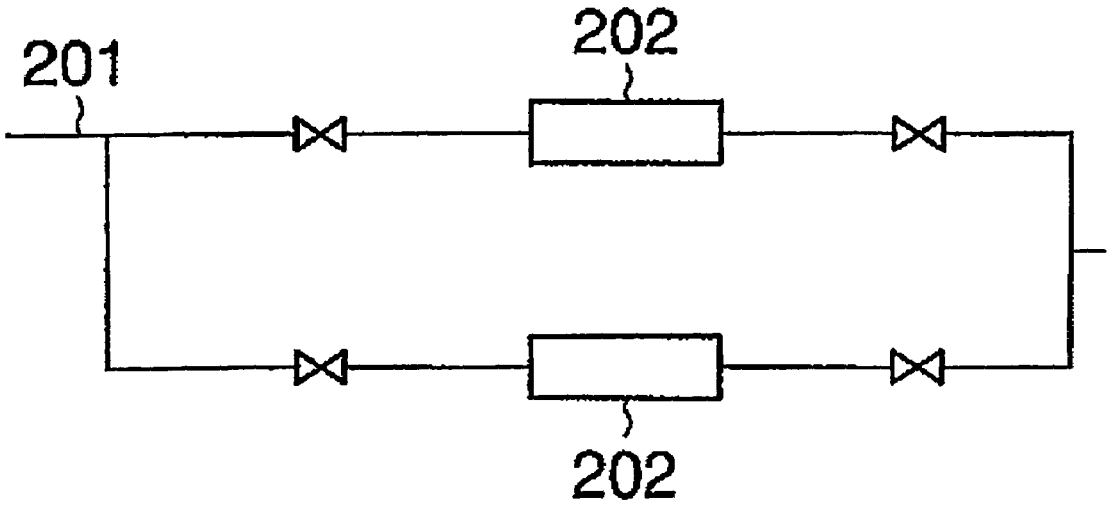
FIG. 2 is a view showing two strainers installed in parallel on a piping for transporting a liquid.

FIG. 2 is an example wherein to prevent a solid from flowing into a pump 203, a pipeline 201 is branched into two pipelines, and a strainer 202 is installed on each branched pipeline. Usually, one strainer is in operation, and when it becomes necessary to take care of the strainer in operation, valves are switched to let the resting strainer start operation. As an example wherein a plurality of branched pipelines each provided with a device for a liquid to pass therethrough are installed in parallel, so that usually, the liquid flowing through the main pipeline is passed through either one of the devices, and if it becomes necessary, the other device is operated by switching the valves, a method may be mentioned wherein two pumps are provided in parallel and alternately operated. Also in the case shown in FIG. 2, each branched pipeline is provided with a valve to close the pipeline, within 500 mm, preferably within 300 mm, from the attached point at each end, whereby it is possible to prevent polymerization at the attached portion of the pipeline during a dormant period.

Figure 3:
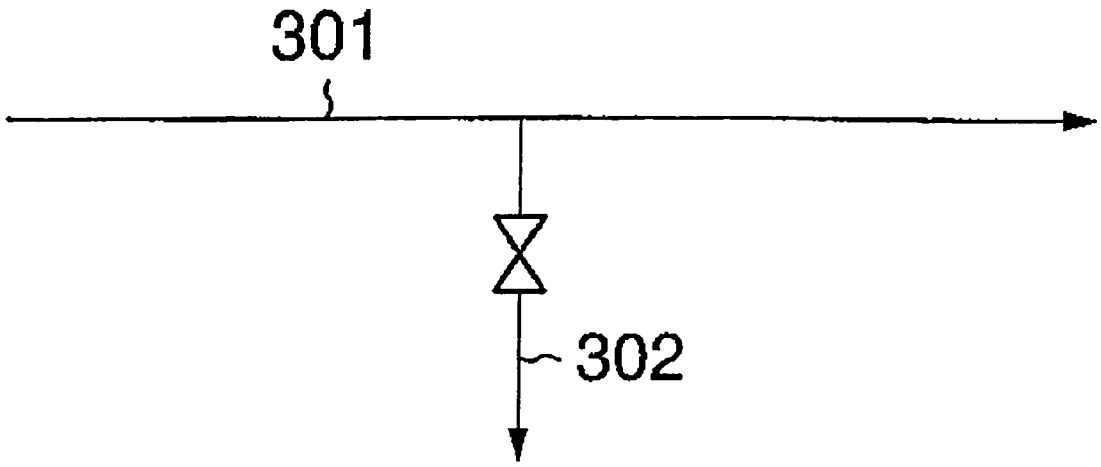
FIG. 3 is a view showing a sample-withdrawing pipe installed on a piping for transporting a liquid.

FIG. 3 is an example wherein a withdrawing pipe 302 is installed to take out a sample from a polymerizable liquid flowing in the main pipeline 301. The withdrawing pipe 302 is slender and is not usually used. Accordingly, a polymerizable liquid remaining in it, is likely to polymerize and clog the withdrawing pipe 302. Also in such a case, by adjusting the position for installing the valve to be within 500 mm, preferably within 300 mm, from the branch point, it is possible to prevent clogging of the withdrawing pipe by polymerization.

A method for installing a bypass pipe in the piping installation for transporting an easily polymerizable compound of the present invention, will be described with reference to the attached drawings.

Figure 5:
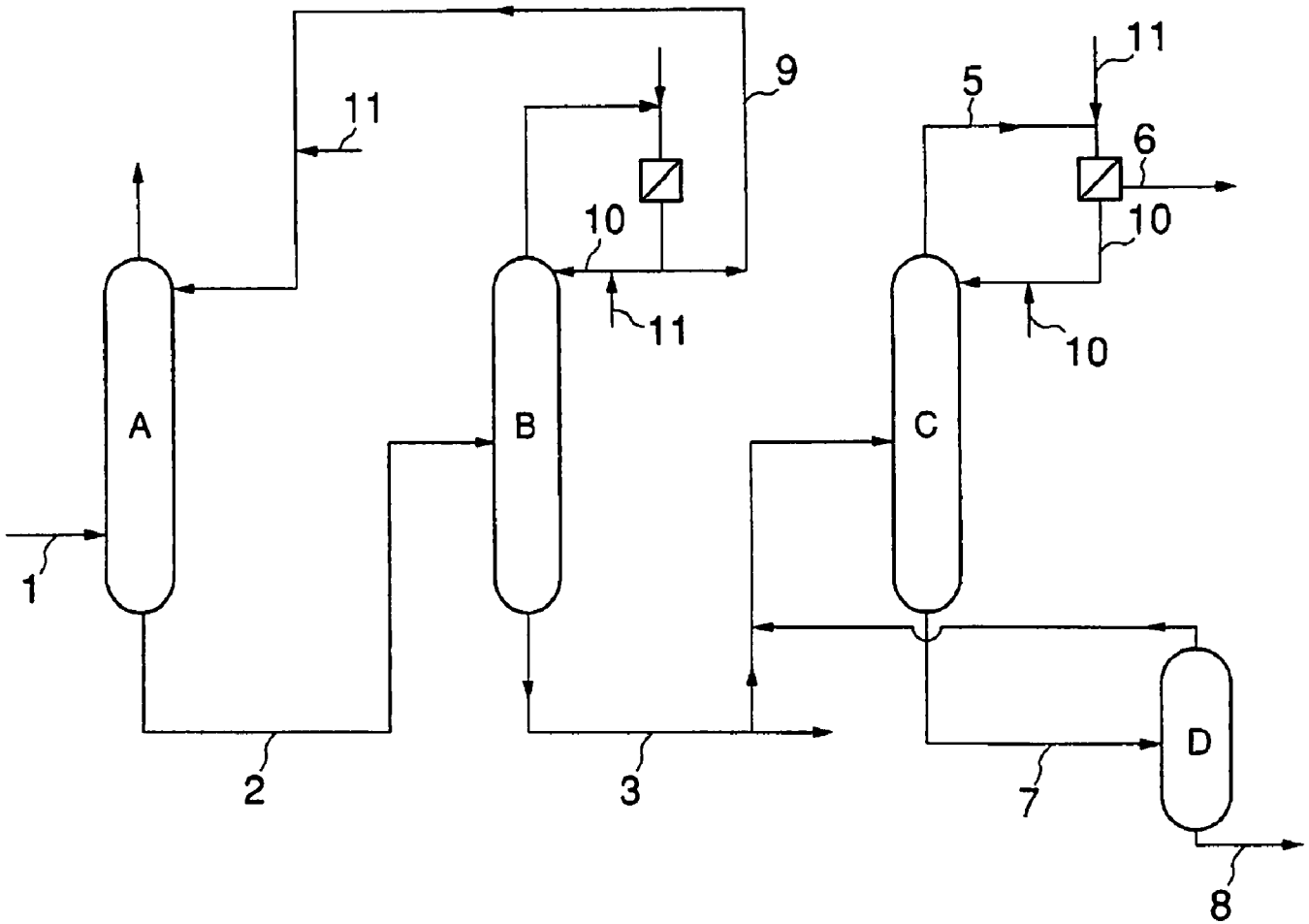
FIG. 5 is a diagrammatical view of a process flow for producing acrylic acid as an easily polymerizable compound.

FIG. 5 is a diagrammatical view of a process flow for preparation of acrylic acid as an easily polymerizable compound. FIGS. 6 to 10 are diagrammatical views illustrating various methods for installing bypass pipes according to the present invention. FIG. 11 is a diagrammatical view illustrating a conventional method for installing a bypass pipe.

Firstly, the diagrammatical view of a process flow for preparation of acrylic acid as shown in FIG. 5, will be described. A is a column for collecting acrylic acid, and to this acrylic acid collecting column A, an acrylic acid-containing reaction gas is supplied from an acrylic acid-containing reaction gas supply line 1. B is a distillation column and to this distillation column B, an aqueous acrylic acid solution is supplied from the bottom of the acrylic acid collecting column A via an aqueous acrylic acid solution-withdrawing line 2. C is a high boiling separation column, and to this high boiling separation column C, crude acrylic acid is supplied from the bottom of the distillation column B via a crude acrylic acid-withdrawing line 3.

The crude acrylic acid supplied to the high boiling separation column C is purified and becomes purified acrylic acid of a high purity, which is withdrawn from the column top by purified acrylic acid-withdrawing lines 5 and 6. D is a high boiling decomposition reactor, and to this high boiling decomposition reactor D, a high boiling point substance is supplied from the bottom of the high boiling separation column C via a high boiling separation column-withdrawing line 7. From the bottom of the high boiling decomposition reactor D, a high boiling substance will be separated and removed via a high boiling decomposition reactor-withdrawing line 8.

Further, reference numeral 9 represents an acrylic acid-collecting water supply line, 10 a reflux line, and 11 a polymerization inhibitor-supply line.

Figure 6:
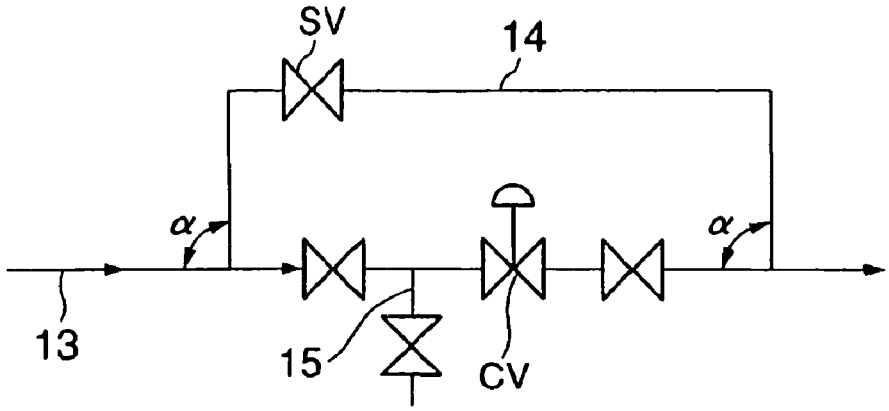
FIG. 6 is a diagrammatical view illustrating Embodiment 1 of the method for installing a bypass pipe of the present invention.

Now, with reference to FIGS. 6 to 10, the method for installing a bypass pipe of the present invention will be described. In FIG. 6, reference numeral 13 represents a main piping disposed horizontally. Such a main piping 13 may be a line connecting various instruments shown in FIG. 1 or a line leading out of the system, but, for example, it may be a line 6 for withdrawing acrylic acid of a high purity withdrawn from the top of the high boiling separation column C, or a withdrawing line 8 of the high boiling decomposition reactor D.

And, on this horizontal main piping 13, a drain pipe 15 is connected, and a control valve CV is also built in. Reference numeral 14 represents a bypass pipe, and this bypass pipe 14 is a piping which is branched from the main piping 13 disposed horizontally, which is rising upwardly at an inclination angle $\alpha$, which overpasses the control valve CV and which is again connected to the main piping 13 at an inclination angle $\alpha$, and it is a bypass pipe for the control valve CV.

Figure 7:
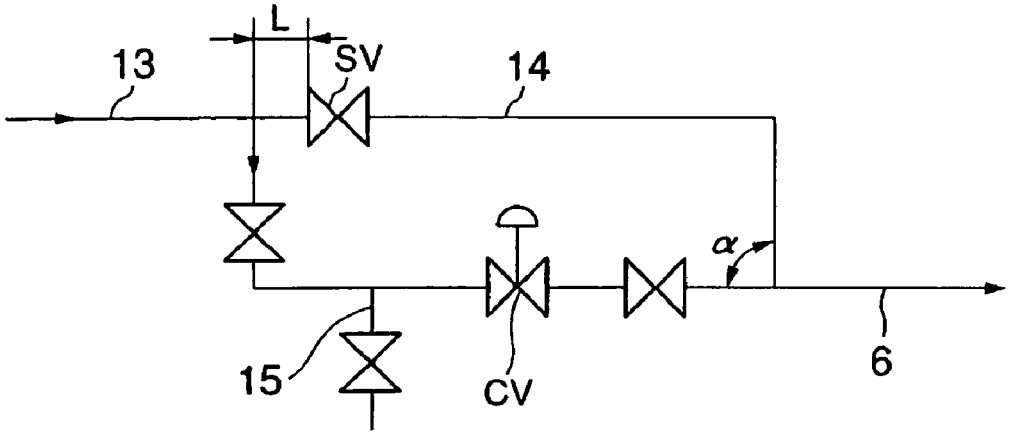
FIG. 7 is a diagrammatical view illustrating Embodiment 2 of the method for installing a bypass pipe of the present invention.

In the example of FIG. 7, a bypass pipe 14 is a piping which is branched in a horizontal direction with a shut off valve SV located with a distance L from the branched portion of the main piping 13 and which is again connected to the main piping 13 at an inclination angle $\alpha$, and it is a bypass pipe for the control valve CV.

Here, the main piping 13 is bent downwardly from the branched portion of the bypass pipe 14, and then disposed horizontally, whereby a drain pipe 15 is connected to the horizontal piping portion, and a control valve CV is built in at the horizontal piping portion, and then it is connected with the bypass pipe 14.

Figure 8:
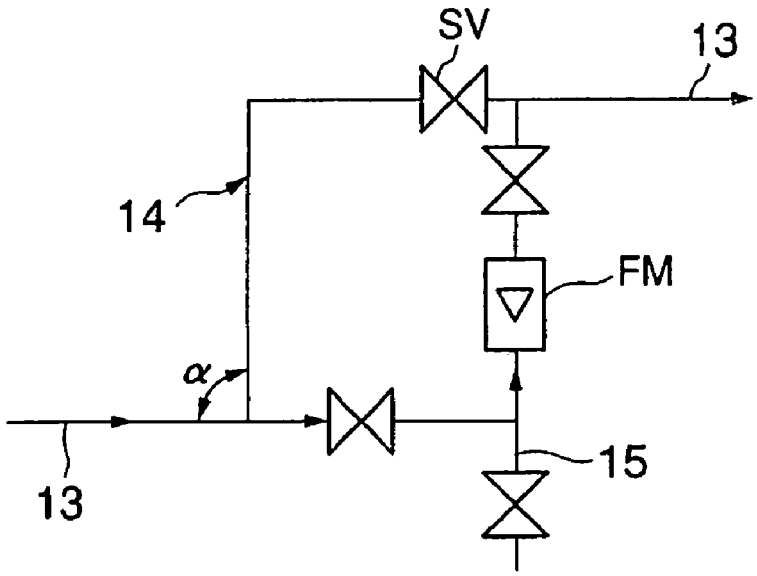
FIG. 8 is a diagrammatical view illustrating Embodiment 3 of the method for installing a bypass pipe of the present invention.

In the example of FIG. 8, a bypass pipe 14 is a piping which is branched from a main piping 13 and is rising upwardly at an inclination angle $\alpha$, which is then disposed horizontally, whereby a shut off valve SV is built in at the horizontal piping portion, and which is again connected to the main piping 13, and it is a bypass pipe for a flow meter FM.

Here, the main piping 13 is disposed horizontally from the branched portion of the bypass pipe 14, and then bent vertically upwardly, whereby the flow meter FM is built in at the vertical piping portion, and then it is connected with the bypass pipe 14. Here, reference numeral 15 is a drain pipe connected to the main piping 13.

Figure 9:
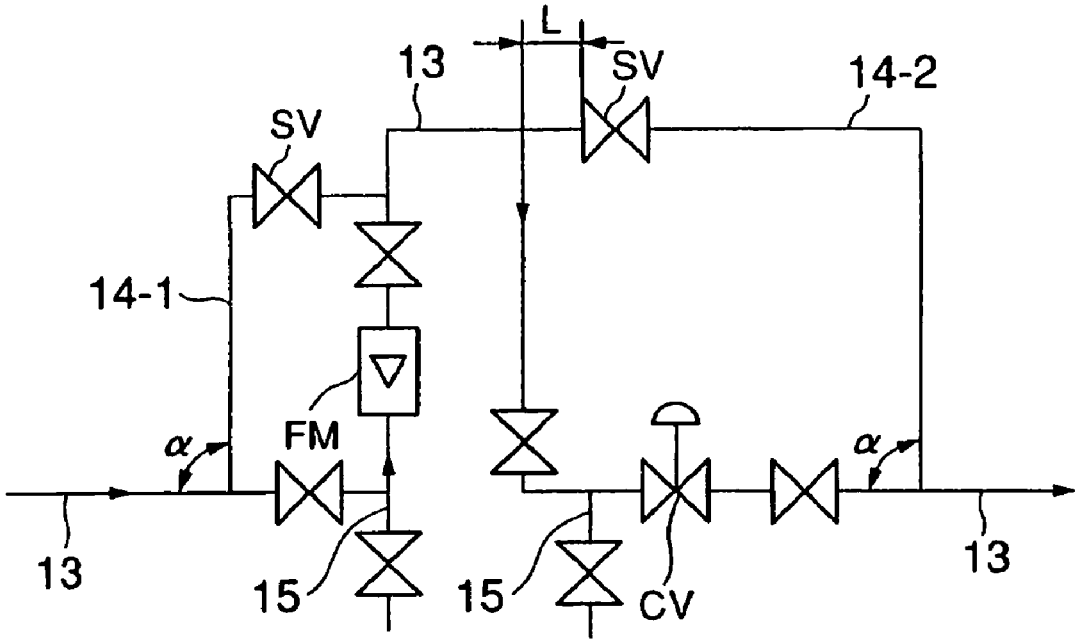
FIG. 9 is a diagrammatical view illustrating Embodiment 4 of the process for installing a bypass pipe of the present invention.

The example of FIG. 9 is a case wherein a flow meter FM and a control valve CV are built in midway of the main piping 13 and represents an example wherein for the flow meter FM and the control valve CV, a bypass pipe 14-1 for flow meter FM and a bypass pipe 14-2 for control valve CV are installed. And, the bypass pipe 14-2 for the control valve CV is a piping which is branched in a horizontal direction with a shut off valve SV located with a distance L from the branched portion of the main piping 13 and which is again connected to the main piping 13 at an inclination angle α. Here, reference numeral 15 represents a drain pipe connected to the main piping 13.

Figure 10:
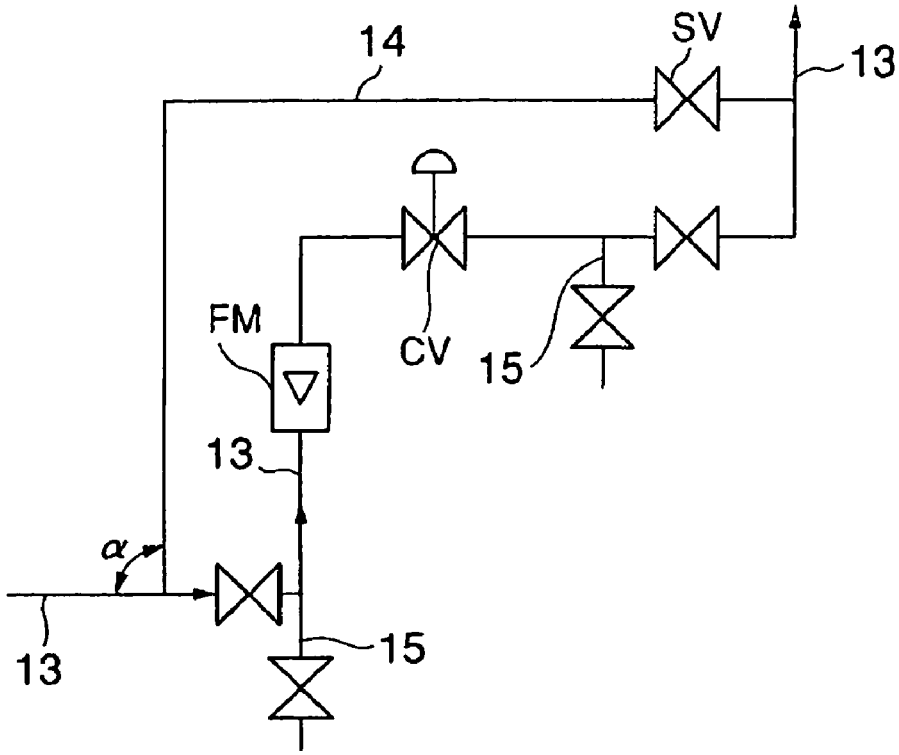
FIG. 10 is a diagrammatical view illustrating Embodiment 5 of the process for installing a bypass pipe of the present invention.
Figure 11:
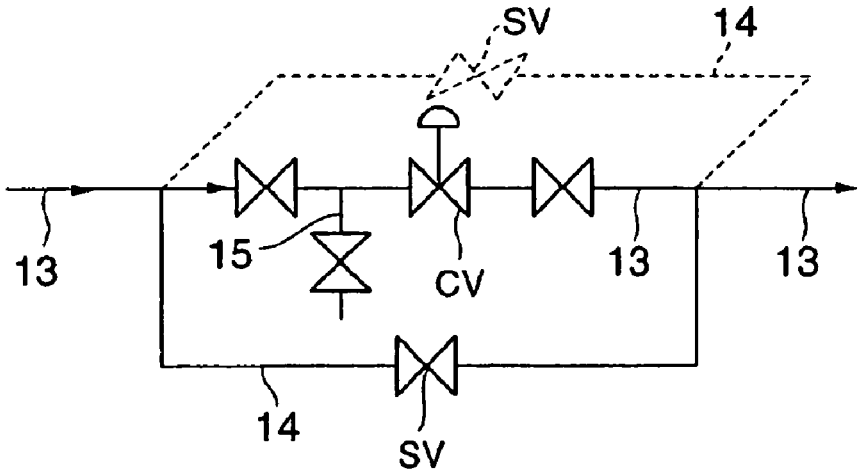
FIG. 11 is a diagrammatical view illustrating a conventional embodiment of a conventional method for installing a bypass pipe.

Also the example in FIG. 10 is a case wherein a flow meter FM and a control valve CV are built in midway of the main piping 13 and represents an example wherein a bypass pipe 14 is installed to overpass the flow meter FM and the control valve CV. Here, reference numeral 15 represents a drain pipe connected to the main piping 13. In the above respective examples, it is possible to employ an orifice type flow meter instead of the control valve CV.

The inclination angle α against the main piping 13, of the bypass pipe 14 rising from the main piping 13, is preferably set to be from 3 to 90° on the acute angle side. If this inclination angle α departs from the prescribed range, there may be a case where no adequate effects of the present invention can be obtained.

Further, in a case where a bypass pipe 14 is installed as branched horizontally from the main piping 13, with a shut off valve SV, the distance L from the branched portion of the main piping 13 to the shut off valve SV is set to be within 50 cm, preferably within 30 cm.

In a case where this distance is short, circulation will result within the branched portion due to the temperature difference or the flow of the liquid in the main piping, whereby the liquid will be renewed. If the distance L of the branched portion is long, the liquid tends to stay for a long time and will not be renewed, whereby polymerization is likely to take place, and clogging is likely to result, such being undesirable. Accordingly, it is advisable to set this distance L to be within 50 cm.

FIG. 11 is an example of a conventional method for installing a bypass pipe. In FIG. 11, reference numeral 13 is a main piping disposed horizontally, and on the main piping 13, a drain pipe 15 is connected, and a control valve CV is built in.

Reference numeral 14 is a bypass pipe and illustrates a conventional method for installing a bypass pipe for the control valve CV, wherein the bypass pipe is branched downwardly as shown by the solid line, from the upper main piping 13 having the control valve CV, and further bent horizontally, whereby a shut off valve SV is built in at the horizontal portion, and bypassing the control valve CV, it is again connected to the main piping 13. Further, there is also a conventional method wherein as shown by a dotted line, the bypass pipe 14 is disposed in a horizontal direction so as to constitute a bypass pipe for the control valve CV.

In the present invention, the easily polymerizable compound means a compound which easily undergoes polymerization to form a polymer during its handling such as a reaction or distillation, and its typical examples include (meth)acrylic acid and its esters, such as methyl, ethyl, butyl, isobutyl, tert-butyl, 2-ethylhexyl, 2-hydroxyethyl, 2-hydroxypropyl and methoxyethyl esters.

Now, the present invention will be described in further detail with reference to Examples. However, it should be understood that the present invention is by no means restricted to such specific Examples.

EXAMPLE 1

Figure 4:
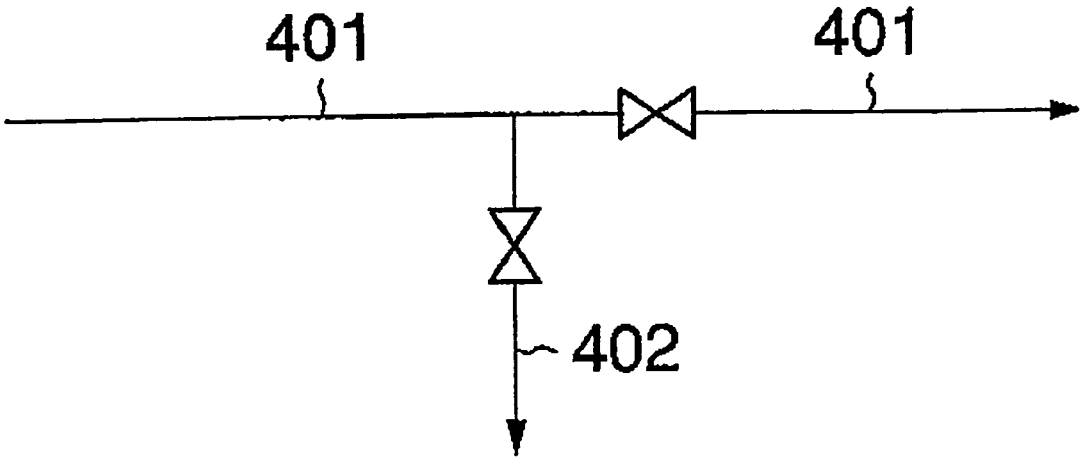
FIG. 4 is a view showing a flow path changing pipe installed on a piping for transporting a liquid.

To purified acrylic acid having a purity of 99.8 wt % at a temperature of 40° C. obtained by distillation for purification, 200 weight ppm of methoxy hydroquinone was added as a polymerization inhibitor, and the obtained mixture was transported via the pipeline (pipe diameter: 1.5 inch) as shown in FIG. 4 at a rate of 1,000 kg/hr. In FIG. 4, reference numeral 401 represents the main pipeline, and 402 represents a piping for withdrawing acrylic acid out of the system when it becomes to be below the standard. Accordingly, the valve for the pipeline 401 is usually open, and the valve for the pipeline 402 is usually closed.

In a case where the valve of the pipeline 402 was installed at a position 1,000 mm from the branch point, when transportation of acrylic acid via the pipeline 401 was carried out for 6 months, whereupon the transportation of acrylic acid was terminated, and the valve of the pipeline 402 was inspected, a polymer was found to be formed in acrylic acid on the upstream side of the valve. Whereas, in a case where the valve of the piping 402 was installed at a position 250 mm from the branch point, and transportation of acrylic acid was carried out in the same manner, when transportation of acrylic acid was terminated upon expiration of 6 months, and the valve of the piping 402 was inspected, no polymer was observed in acrylic acid on the upstream side of the valve.

EXAMPLE 2

An example of a process for producing acrylic acid will be shown.

In FIG. 9, the bypass pipe 14-1 for the flow meter FM was branched from the horizontal portion of the main piping 13 on the inflow side of the flow meter FM and was rising upwardly at an inclination angle α of 90°, and a shut off valve SV was provided, and then it was connected at a right angle to the main piping 13 on the outflow side of the flow meter FM.

On the other hand, the bypass pipe 14-2 for the control valve CV was branched horizontally from the horizontal portion of the main piping 13 on the inflow side of the control valve CV, whereby a shut off valve SV was installed at the horizontal portion with a distance L=30 cm from the branch point, and then, the bypass pipe 14-2 was vertically downwardly bent and connected at an inclination angle α of 90° to the horizontal portion of the main piping 13 on the outflow side of the control valve CV.

The composition withdrawn from the high boiling separator C was such that acrylic acid was 60 wt %, an acrylic acid dimer 25 wt % and maleic anhydride 8 wt %, and the temperature was 80° C.

After operation for three months, clogging of the flow meter FM was observed, and during the replacement operation, the operation was continued by passing the withdrawing liquid through the bypass pipe 14-1. There was no clogging of the bypass pipe 14-1, and after restoring the flow meter FM, it was possible to continue the operation for a total of 6 months.

EXAMPLE 3

An example for a process for producing butyl acrylate will be shown.

In FIG. 7, a shut off valve SV built in at the horizontal portion of the bypass pipe 14, was installed at 30 cm from the branched portion of the bypass pipe 14, and then, the bypass pipe 14 was connected vertically (inclination angle α=90°) to the main piping 13.

The composition withdrawn of the high boiling decomposition reactor D was such that acrylic acid was 7 wt % (not including an acrylic acid dimer), butyl butoxypropyonate 68 wt %, butyl acrylate 11 wt %, and others (polymers or inhibitor, etc.) 14 wt %, and the temperature was 140° C.

After operation for 5 months, clogging of the control valve CV was observed, and during the replacement operation, the operation was continued by passing the withdrawing liquid through the bypass pipe 14. There was no clogging of the bypass pipe 14, and after restoring the control valve CV, it was possible to continue the operation for a total of 10 months.

COMPARATIVE EXAMPLE 1

As shown in the solid line in FIG. 11, the bypass pipe 14 for the control valve CV was installed below the horizontal position of the main piping 13, and operation was carried out in the same manner as in Example 1.

After operation for three months, clogging of the control valve CV was observed, and during the replacement operation, the operation was continued by passing the withdrawn liquid through the bypass pipe 14, whereby clogging of the bypass pipe 14 was observed, and it was necessary to stop the operation.

INDUSTRIAL APPLICABILITY

According to the present invention, even if a branched pipe which is not usually used, is installed on a pipeline for transporting an easily polymerizable liquid such as acrylic acid in a plant, it is possible to prevent polymerization of the easily polymerizable liquid at a portion from the branch point to a valve for closing the branched pipe.

Further, according to the present invention, it is possible to provide a method for installing a bypass pipe, whereby in a piping installation for transporting a easily polymerizable substance such as (meth)acrylic acid, it is possible to effectively prevent clogging of the bypass pipe and thereby to continue the operation even at the time of clogging of an instrument such as a flow meter or a control valve built in the piping installation. Thus, it is possible to prevent a decrease in productivity and thus to bring about a substantial merit from industrial viewpoint.

The entire disclosures of Japanese Patent Application No. 2001-368496 filed on Dec. 3, 2001 and Japanese Patent Application No. 2002-013814 filed on Jan. 23, 2002 including specifications, claims, drawings and summaries are incorporated herein by reference in their entireties.

What is claimed is:

1. A method for transporting an easily polymerizable liquid by a pipeline, said method comprising:

providing the pipeline with a bypass pipeline having a length of at most 1000 mm to bypass a part of the pipeline; and providing the bypass pipeline with only one valve to close the bypass pipeline, the valve being within 500 mm from the attached point at each end of the bypass pipeline.

2. The method according to claim 1, wherein at least a part of the bypass pipeline is installed at an elevation higher than the main pipeline.

3. The method according to claim 1, wherein at least a part of the branched portion or the connected portion of the bypass pipeline extends upwards from the main pipeline at an inclination angle of from 3 to 90°.

4. The method according to claim 1, wherein one end of the bypass pipeline is branched from a position at a same height as the main pipeline, and the valve is disposed at a portion of the bypass pipeline located at said same height.

* * * * *